United States Patent [19]

Kessler

[11] 3,944,157

[45] Mar. 16, 1976

[54] FABRIC REEL END FRAME

[75] Inventor: Theodore P. Kessler, Rancocas, N.J.

[73] Assignee: Timron, Inc., Moorestown, N.J.

[22] Filed: Apr. 18, 1973

[21] Appl. No.: 352,184

[52] U.S. Cl. ..... 242/77.1; 206/395; 206/408; 242/77.3

[51] Int. Cl.[2] ..... B65D 85/671; B65H 75/25

[58] Field of Search ..... 206/389, 396, 408, 395, 206/397, 407; 242/77.1, 77.2, 77.3, 77.4

[56] References Cited

UNITED STATES PATENTS

| | | | |
|---|---|---|---|
| 2,494,522 | 1/1950 | Schaefer | 242/77.3 |
| 2,574,845 | 11/1951 | Schaefer | 242/77.3 |
| 2,922,516 | 1/1960 | Kessler | 242/77.1 |
| 2,976,987 | 3/1961 | Kessler | 206/408 |
| 3,645,383 | 2/1972 | Lekane | 206/400 |

FOREIGN PATENTS OR APPLICATIONS

| | | | |
|---|---|---|---|
| 806,851 | 4/1951 | Germany | 242/77.1 |

*Primary Examiner*—William Price
*Assistant Examiner*—Stephen Marcus
*Attorney, Agent, or Firm*—Kenyon & Kenyon Reilly Carr & Chapin

[57] ABSTRACT

The fabric reel end frame for a shipping carton is constructed with radiating hook containing sections secured in metal-to-metal contact to a centrally located flat outer plate. In addition, a board, such as cardboard, is sandwiched between the plate and hook containing sections and a compression plate is mounted centrally between the hook containing sections. The board is provided with holes through which protuberances on the outer plate pass into contact with the hook containing sections and rivets pass through the protuberances to secure the plate to the hook containing sections. Drill holes are formed in the outer plate to facilitate driving of the end frame in a winder for winding pile fabric onto the reel.

16 Claims, 8 Drawing Figures

FABRIC REEL END FRAME

This invention relates to a fabric reel end frame. More particularly, this invention relates to a pile fabric reel end frame and a shipping carton utilizing such an end frame.

Heretofore, various types of fabric reels have been known for storing and transporting pile fabrics such as velvet and plush in layered conditions for example as disclosed in U.S. Pat. No. 3,593,847. In some cases, these fabric reels have been constructed so as to become a part of a shipping carton within which a loaded reel is shipped. For example, it has been known to incorporate a board in a reel end frame which acts as an end wall of the shipping carton. In such a case, the end frame has generally been made up of a pair of plates, a cardboard sheet and a plurality of hook containing sections. The cardboard sheet has usually been sandwiched between the two plates with rivets passing through the two plates, the cardboard sheet and hook containing sections to form an integral unit of the various components. In addition, other rivets have been passed through the outer plate, the cardboard sheet and the hook containing sections, e.g. to add rigidity. However, the outer plate has generally had a relatively bulky profile shape due in part to a need to provide a gripping surface for rotating the end frame in a fabric winder. As a result, when shipping a number of end frames for use in making up reels, the end frames have occupied a relatively great deal of space. Thus, for a given height of stack, a relatively low number of end frames can be transported, e.g. about 1500 per fourty-foot van. In addition, the inner plate which is usually flat and on the same side of the cardboard sheet as the hook containing sections, has usually been provided with a central circular aperture sized to slidably receive a spacer tube or bar therein without locking the tube in place. Because of this, the two end frames making up a reel may be brought closer together, for example, due to the tension of the fabric wound on the reel or due to the dropping of a shipping carton. As a result, the tension in the fabric can be relaxed to such a degree as to damage the fabric, e.g. crushing of the pile. In order to prevent this, some reel frames have been provided with various types of locking means to prevent the spacer bar from moving into the end frames after a fabric has been impaled. Similar means have also been used to prevent rotation of the spacer bar relative to the end frame after a fabric has been put in place. In order to provide for these various means, additional plates or members have been required. However, these require additional space during shipping as well as additional fabrication procedures which can be time consuming and laborious.

Accordingly, it is an object of the invention to provide an end frame for a fabric reel which is of relatively small thickness.

It is another object of the invention to provide an end frame of small profile for shipping purposes.

It is another object of the invention to provide an end frame for a fabric reel which can be shipped in relatively large quantities in a limited space.

It is another object of the invention to provide a relatively rigid end frame which incorporates a cardboard sheet therein for use as one end of a shipping carton.

It is another object of the invention to provide an end frame for a reel of fabric composed of a minimum of parts.

Briefly, the invention provides an end frame for a fabric reel comprising a plate, a plurality of hook containing sections for impaling a fabric thereon, a board and means for securing each hook containing section at an outer end to the board. The hook containing sections are secured to the plate at predetermined points to extend outwardly from the plate in a radiating pattern which being in metal-to-metal contact with the plate at these points. The board is disposed between the plate and the hook containing sections and is provided with suitable cutouts or holes at the points where the hook containing sections are secured to the plate.

In order to secure the hook containing sections to the plate, rivets can be passed through each hook containing section and the plate. Similar rivets can also be used with or without washers on the opposite side of the board from the hook containing section to secure the hook containing sections to the board at their outer ends.

In order to facilitate securement of the plate to the hook containing sections, the plate is provided with a plurality of protuberances which project through the holes in the board. These protuberances contact the respective hook containing sections and are provided with holes for passage of the securing rivets.

The plate is of flat shape to have a limited profile and includes an inner annular flange projecting perpendicularly about a central opening to receive a spacer tube thereon in a snug relation. The board is similarly provided with an opening sized to permit passage of the flange of the plate. The flange increases the stability of the end frame while also providing a smooth surface into the inside face of the end frame.

The board is of rectangular or square shape and includes an integral peripheral flange which can be folded to extend perpendicularly in a direction away from the hook containing sections. This flange allows the end frame to be secured to an enveloping shipping tube, as by staples or other clips, to close off one end of the shipping tube. The flange can be formed when the shipping carton is to be made up, so that the board can remain in a flat condition when the end frame is shipped in bulk or is stored.

In addition, the end frame includes a lock plate mounted centrally between the hook containing sections. The lock plate serves as a compression plate to further rigidify the end frame while also acting as a lock plate to secure a spacer tube or bar in place when a reel is made up of two end frames. Each hook plate is sized to be secured to the inner ends of the hook containing sections in any suitable manner. In addition, each lock plate has a plurality of tangs which project inwardly so as to be embedded in the spacer bar or tube to hold the bar or tube in place after a fabric has been reeled up against the tension force of the fabric. These tangs may also serve to permit movement of the end frames away from each other to impart increased tension in the reeled fabric while preventing movement of the end frame together.

The overall thickness or profile thickness of the end frame is of a relative minimum due to the flatness of the plate on the outside of the end frame. Thus, a large number of end frames can be stacked within a limited space for shipping purposes. In this case, it is noted that the hook containing sections are nested one within the other during shipping or storage. For example, end frames of the invention of standard width and height, e.g. 30 inches by 30 inches, can be shipped in bulk at about 2500 per 44 foot shipping van as opposed to about 1500 of other known types of the same width and height, as indicated above.

These and other objects and advantages of the invention will become more apparent from the following detailed description and appended claims taken in conjunction with the accompanying drawings in which:

Figure 1:
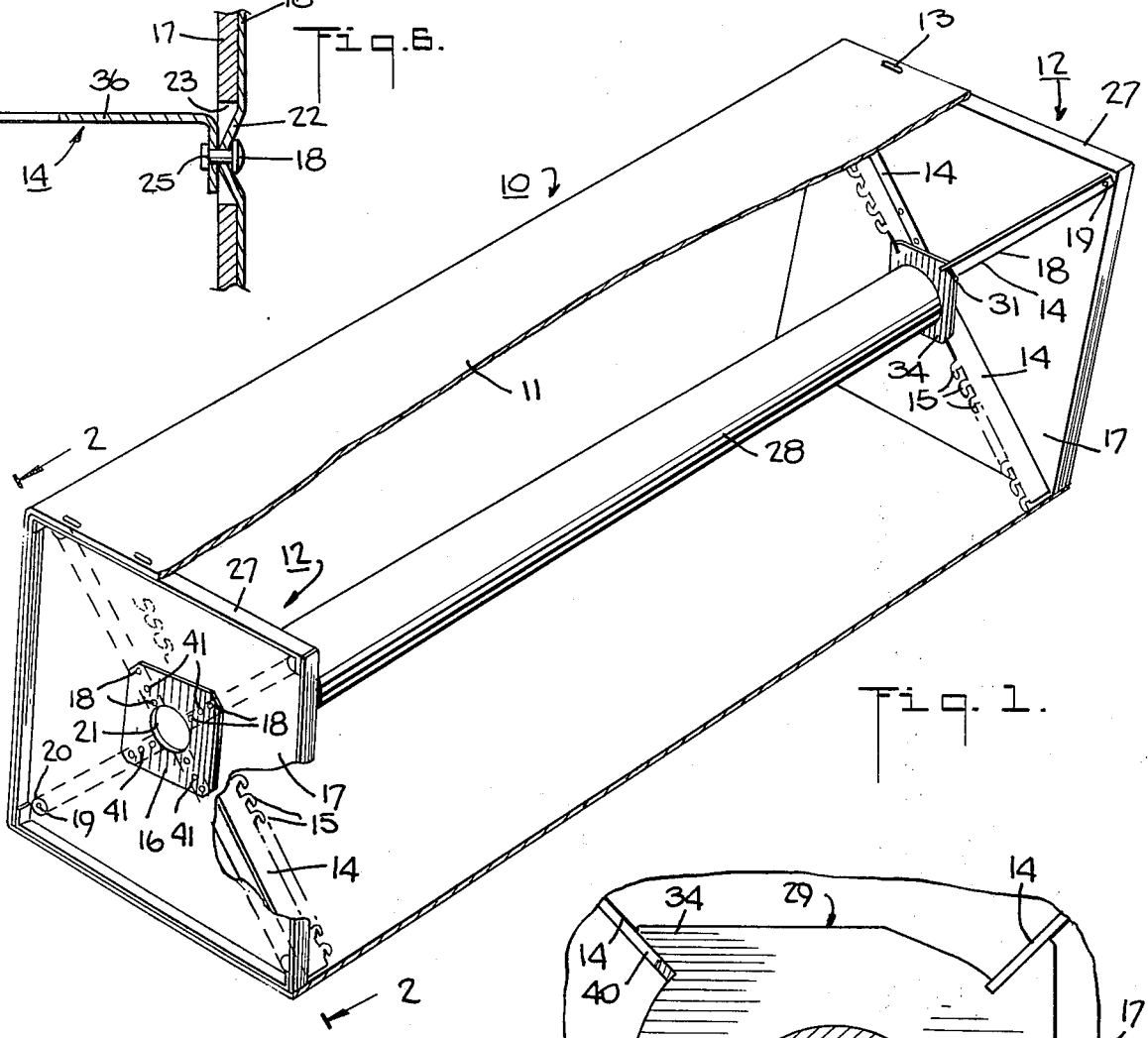
FIG. 1 illustrates a shipping carton composed of a pair of end frames according to the invention.

Referring to FIG. 1, shipping carton 10 is constructed of a shipping tube 11 of elongated shape and of generally rectangular cross section as well as a pair of end frames 12 which are secured at the ends of the shipping tube 11 by suitable means such as staples or clips 13 as is known.

Figures 3, 4, 5:
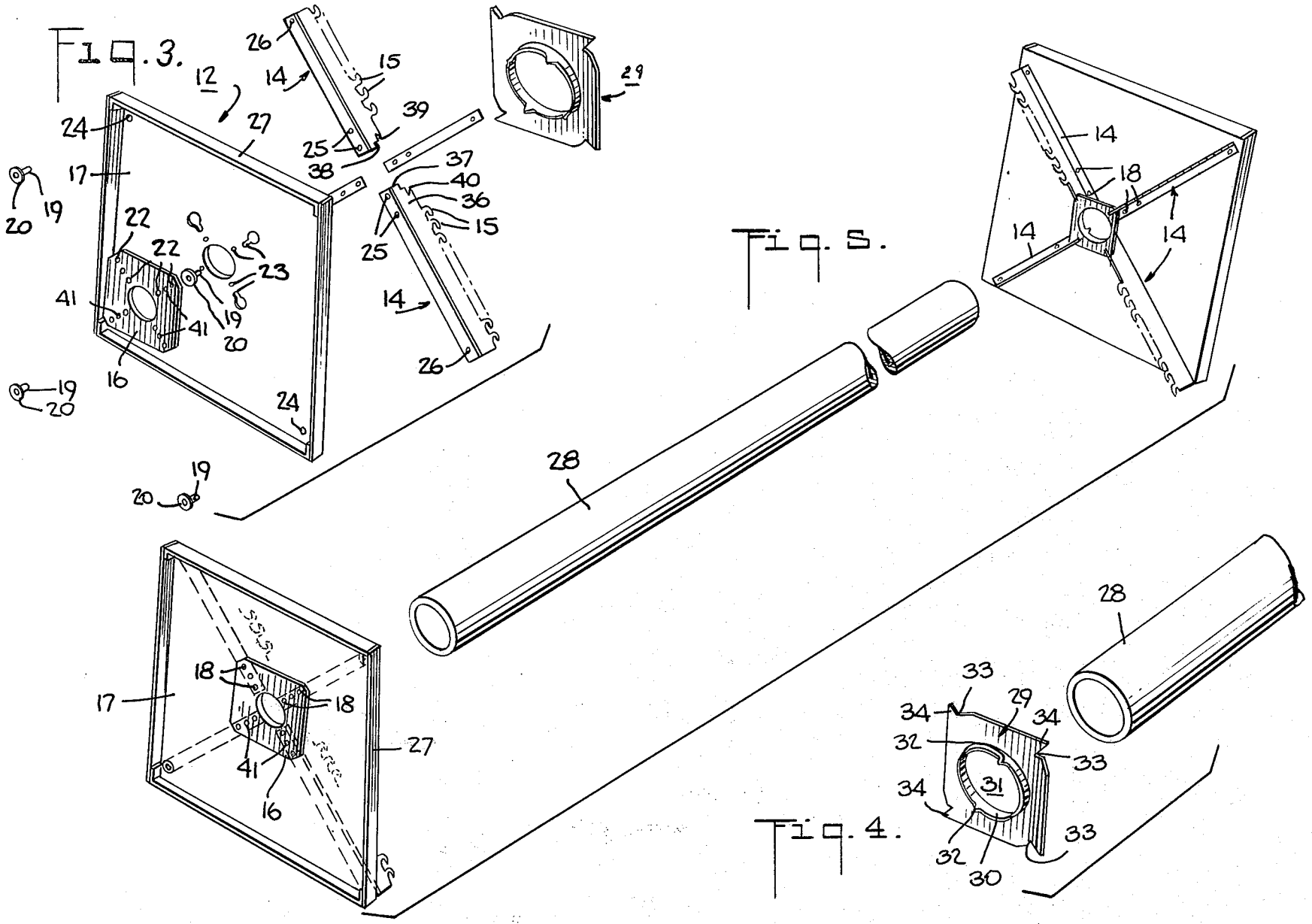
FIG. 3 illustrates an exploded view of an end frame according to the invention.
FIG. 4 illustrates an exploded view of a lock plate according to the invention with a spacer bar.
FIG. 5 illustrates an exploded view of the shipping carton of FIG. 1 without the shipping tube.

Referring to FIGS. 1, 3 and 5, each end frame 12 is constructed of a plurality of L-shaped hook containing sections or hook plates 14 which are provided with hooks 15 for impaling the edges of a fabric (not shown) such as velvet or plush thereon in known fashion. In addition, the end frame 12 includes a plate 16 secured to the hook containing sections 14 with the hook containing sections 14 disposed in a radiating pattern. Also, a board 17 such as, a flat cardboard, is sandwiched between the hook containing sections 14 and the plate 16.

The plate 16 is secured to the hook containing sections 14 in a metal-to-metal contact in any suitable manner such as by a number of rivets 18. Similar rivets 19 are also passed through the board 17 and the outer ends of the hook containing sections 14 to secure the hook containing sections 14 directly to the board 17. For this purpose, washers 20 are provided on the outside face of the end frame 12 about the rivets 19 although the washers 20 can be omitted.

Figure 2:
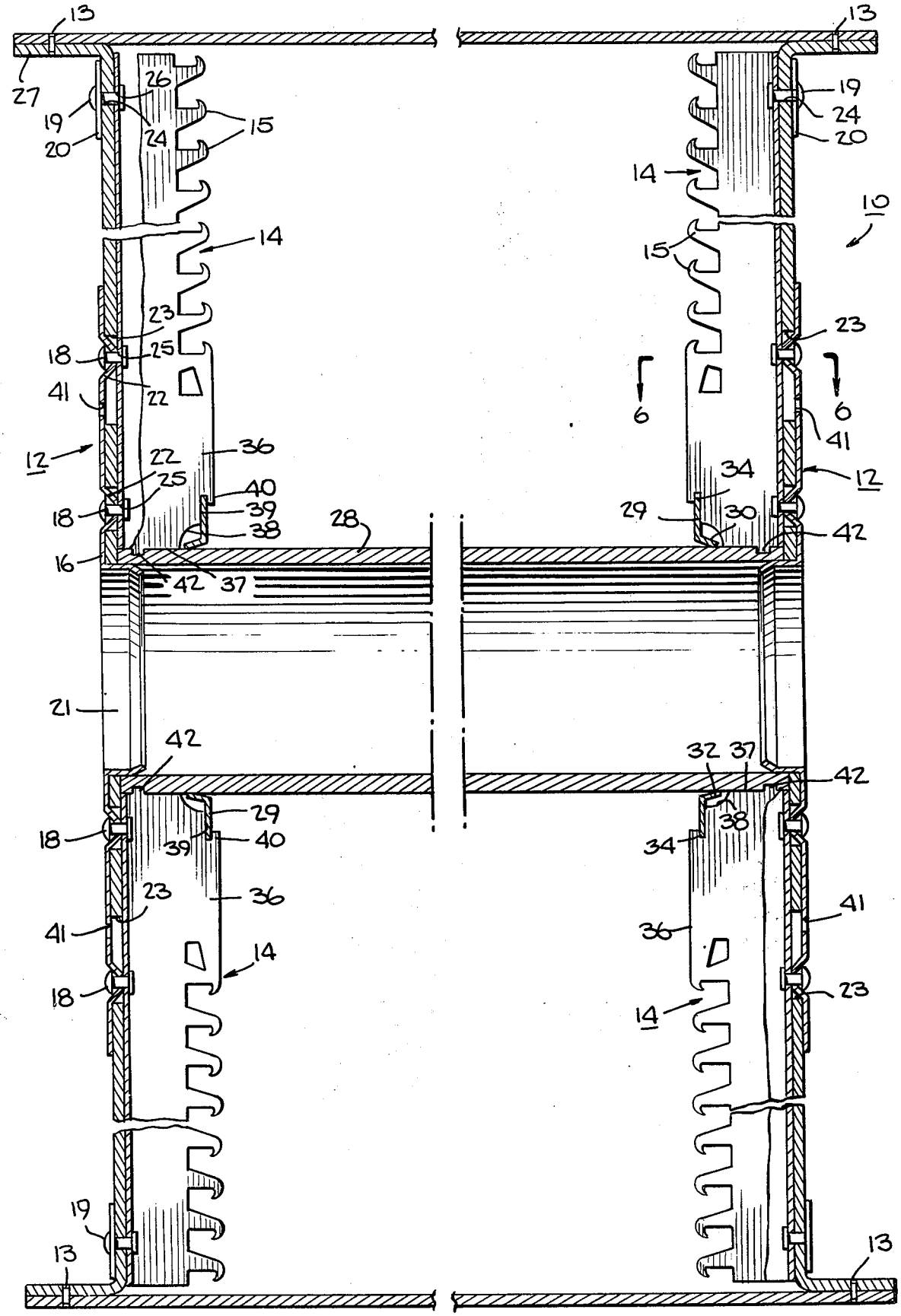
FIG. 2 illustrates a view taken on line 2—2 of FIG. 1.

Referring to FIG. 2, the plate 16 is of generally flat rectangular shape and is provided with an inner annular flange 21 which is slightly tapered inwardly and serves to define a surface to receive a spacer tube 28 as described below while also defining a central opening within the plate 16. In addition, the plate 16 is provided with pairs of apertured protuberances 22 which are oriented in the surface of the plate 16 in a radiating pattern relative to the corners of the plate 16. Also, a set of drill holes 41 are formed in the plate 16, one each between the protuberances 22. The board 17 is provided with pairs of holes 23, 23′ aligned with the protuberances 22 in the plate 16 which are of a size to permit passage of the protuberances. In addition, the outer holes 23′ are each of a keyhole shape to be aligned with a protuberance 22 and a drill hole 41 in the plate 16. Other holes 24 are also provided in the board 17 near the outer corners to facilitate passage of the rivets 19.

Each hook containing section 14 also has holes 25 aligned with the protuberances 22 and the holes 23 in the board 17 to facilitate passage of the rivets 18 therethrough and holes 26 in the outer ends to permit passage of the rivets 19.

Figure 6:
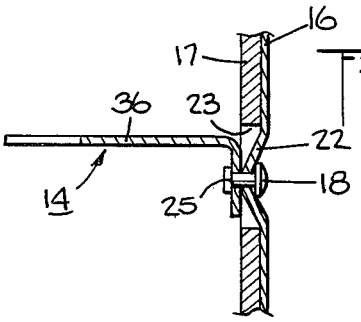
FIG. 6 illustrates a view taken on line 6—6 of FIG. 2.

As shown in FIG. 6, each protuberance 22 of the plate 16 is sized to come into direct contiguous contact with a hook containing section 14 disposed on the opposite side of the board 17. In this way, the metal-to-metal contact of the plate 16 and the hook containing sections 14 is achieved to provide a more secure arrangement imparting rigidity to the hook containing sections 14. In this regard, it is noted that if the board 17 were interposed between the protuberances 22 of the plate 16 and the hook containing sections 14, looseness of the end frame could occur over a period of time due to warping or disintegration of the board 17, caused, for example, by the board becoming wet and limp over a period of time.

The board 17 has a peripheral flange 27 which is integral with the remainder of the board 17 and which projects perpendicularly to the remainder of the board 17. This flange 27 is formed in any conventional fashion such as by slitting the board 17 near each corner and by folding in the edges of the board 17 about the slit with the resultant tab on one side edge of the board 17 being folded over and secured to the edge on the other side edge of the board 17. The formation of the flange 27 is conventional and no further description is believed to be necessary.

Referring to FIG. 2, each end frame 12 also has an apertured lock plate 29 mounted on the hook containing sections 14 coaxially of the plate 16 to receive a spacer tube 28. As shown in FIG. 2, the lock plate 29 is of rectangular shape and is of a generally flat contour or profile. In addition, the lock plate 29 has a flange 30 projecting perpendicular therefrom to define a central opening 31 which is sized to snugly receive the spacer tube 28 therein. The diameter of the opening 31 is substantially equal to the outer diameter of the tube 28. The flange 30 has a plurality of tangs 32 projecting at a slight inward angle towards the axis of the tube 28 so as to embed in the spacer tube 28 as explained below. The plate 29 also has a recess 33 at each corner which serves to form a sharp projection 34 at each corner.

Figure 8:
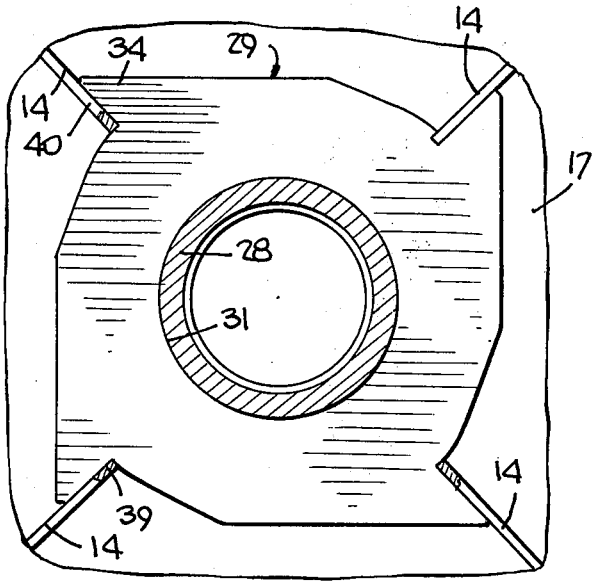
FIG. 8 illustrates a view of the locking plate secured in place on the hook containing sections.
Figure 7:
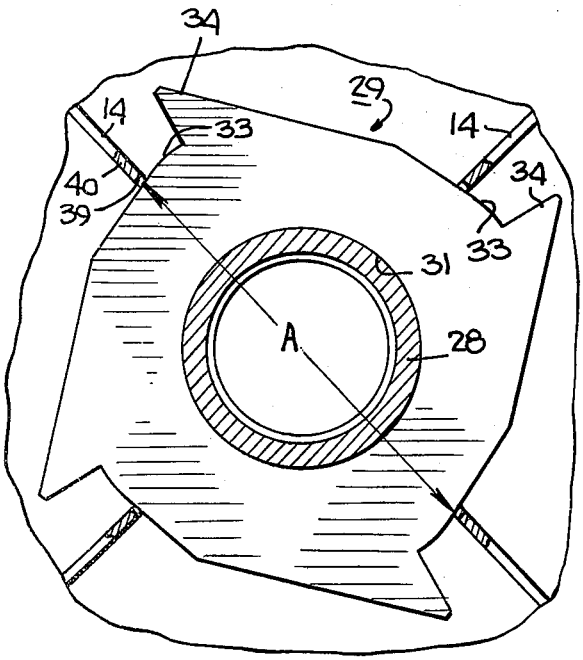
FIG. 7 illustrates a view of the locking plate immediately prior to securement in place.

Referring to FIG. 2, each hook containing section 14 is provided with a profiled end on the upstanding leg 36. The profiled end includes an upstanding portion 37, a curvilinear portion 38, a ledge portion 39, and a shoulder portion 40. As shown, the shoulder portion 40 projects over the ledge portion 39. The distance between opposite hook containing sections 14 is substantially equal to the diameter of the central opening 31 in the lock plate 29 and the diameter of the tube 28. As shown, the straight portion 37 of each hook containing section 14 carries a tab 42 which penetrates into the cardboard spacer tube 28 while the spacer tube 28 is snugly received between the inwardly tapered flange 21 of the plate 16 and the hook containing sections 14. In addition, the lock plate 29 of each end frame rests on the ledge portion 39 of each hook containing section 14 under the shoulder portion 40 of each. Referring to FIG. 7, in order to place the lock plate 29 in position, the lock plate 29 is first laid on the ledge portions 39 of the hook containing sections 14 so that the projections 34 are spaced from the respective shoulder portions 40. Thereafter, as shown in FIG. 8, the lock plate 29 is rotated until the projections 34 abut against the upstanding legs 36 of the hook containing sections 14. At this time, the lock plate 29 is frictionally locked within the hook containing sections 14. As shown in FIG. 7, in order to facilitate the locking fit of the lock plate 29 in the sections 14, the plate diameter A where the lock plate 29 is first placed on the ledge portions 39 is the smallest diameter. Rotation of the plate 29 against the legs 37 creates a compressive force on the plate via the sections 14 to lock the plate 29 in place.

Referring to FIG. 3, in order to fabricate an end frame 12, the plate 16, board 17 and respective hook containing sections 14 (e.g. four) are placed in alignment. Thereafter, the rivets 18 are passed through the holes in the plate 16, the board 17 and the hook containing sections 14 and deformed on the hook containing side of the board 17 to secure the components together into a rigid structure. In addition, the rivets 19 are passed through the washers 20, the board 17 and the hook containing sections 14 and similarly deformed to secure the outer ends of the hook containing sections 14 to the board 17. Next, the lock plate 29 is placed on the ledge portions 39 (FIG. 7) and rotated, e.g. manually, until the projections abut the legs 36 (FIG. 8). The resultant structure can then be shipped in this form without forming the flange 27 so that the board 17 remains flat. The slit in the corners of the board 17 can be made during fabrication so as to facilitate assembling of the end frame into a shipping carton at a later time.

In order to assemble a reel, two end frames 12 are slid over the spacer tube 28 to a predetermined point sufficient to permit reeling on of a determined width of fabric under tension. During this time, the tangs 32 which are sufficiently resilient slide along the surface of the spacer tube 28. Thereafter, should an attempt be made to pull the end frames 12 off the spacer tube 28, the tangs 32 bite into the surface of the tube 28 to prevent removal. In this way, the integrity of the reel is maintained during shipping within the shipping carton. This reduces the possibility of a situation occurring in which the end frames 12 would be disconnected from each other causing the fabric material to pile up within the shipping carton.

When winding a fabric onto or off the reel, the end frames 12 of the reel would usually be placed in a winder frame with the end frames gripped in some fashion for a positive drive. In the case of the above reel, suitable drive pins (not shown) can be used in the winder drive motion (not shown) to pass through the holes 41 in the plates 16 (FIG. 1) and provide a drive transfer means for rotating the reel.

The invention thus provides an end frame for a pile fabric reel which can be easily constructed in a rapid manner from a minimum of parts. Further, the invention provides an end frame which can be shipped in stacked fashion in relatively large quantities since the thickness of the plate securing the hook containing sections together is basically flat. In this respect, it is noted that the protuberances on each plate project through the thickness of the board and are of a thickness or height substantially equal to the thickness of the board. Therefore, the protuberances do not increase the overall thickness of the end frame.

Since the hook containing sections are each secured to the plate at two metal-to-metal contact points, the resultant structure is relatively rigid.

The invention provides an end frame which is relatively inexpensive to manufacture in large quantities, easy to transport and of minimum bulk for shipping. Further, the end frames are of relatively long life for use in shipping of fabrics such as pile fabric.

What is claimed is:

1. An end frame for a fabric reel comprising
a plate;
a plurality of hook-containing sections for impaling a fabric material thereon secured to said plate at predetermined points, said sections being in contact with said plate at said points and extending outwardly from said plate in a radiating pattern;
a board disposed between said plate and said sections; and
means for securing each said section at an outer end thereof to said board.

2. An end frame as set forth in claim 1 which further comprises a plurality of rivets securing said sections to said plate.

3. An end frame as set forth in claim 1 wherein said plate has an annular flange projecting perpendicularly therefrom about a central opening in said plate and passing through an aperture in said board.

4. An end frame as set forth in claim 1 wherein said means includes a washer disposed on an opposite side of said board from said hook containing sections and a rivet passing through said washer and a respective hook containing section.

5. An end frame as set forth in claim 1 wherein said board is of rectangular shape and has a peripheral flange extending perpendicularly therefrom in a direction away from said hook containing sections.

6. An end frame as set forth in claim 1 further comprising a lock plate mounted on said hook containing sections on an opposite side of said board from said first plate, said lock plate having a central aperture therein.

7. An end frame as set forth in claim 1 wherein said board has a plurality of holes located within the plane of said plate and said plate has a plurality of protuberances projecting through said holes, each said protuberance being in contact with a respective one of said hook containing sections.

8. An end frame as set forth in claim 7 which further comprises a plurality of rivets, each rivet passing through a respective one of said protuberances and a respective one of said hook containing sections.

9. In an end frame for a fabric reel, the combination comprising a plurality of hook containing sections for impaling a fabric material thereon, a plate secured in contacting relation at predetermined points to said hook containing sections centrally of said section, and a board disposed between said plate and said hook containing sections.

10. In an end frame as set forth in claim 9 wherein said plate has a plurality of drill holes receiving driving pins of a winder.

11. In an end frame as set forth in claim 9, said board having a plurality of holes located within the plan of said plate and said plate having a plurality of protuberances projecting through said holes into contact with respective ones of said hook containing sections.

12. In an end frame as set forth in claim 11, a plurality of rivets, each rivet passing through a respective one of said protuberances and a respective one of said hook containing sections.

13. In an end frame as set forth in claim 12, means securing each said hook containing sections at an outer end thereof to said board.

14. In combination, an end frame for a fabric reel including a plurality of hook containing sections for impaling a fabric material thereon, a plate secured in contacting relation to said hook containing sections, a board disposed between said plate and said hook containing sections, and a lock plate secured to said hook containing sections on a side of said board opposite said first plate and having a central aperture therein; and a spacer bar mounted within said aperture of said lock plate and extending perpendicularly therefrom.

15. The combination as set forth in claim 14 wherein said lock plate includes a plurality of tangs embedded in said bar to hold said bar in place relative to said end frame.

16. The combination as set forth in claim 14 wherein said first plate has a central aperture and an annular flange about said central aperture thereof, said spacer tube being slidably mounted on said flange.

* * * * *

UNITED STATES PATENT AND TRADEMARK OFFICE

CERTIFICATE OF CORRECTION

PATENT NO. : 3,944,157

DATED : March 16, 1976

INVENTOR(S) : Theodore P. Kessler

It is certified that error appears in the above-identified patent and that said Letters Patent are hereby corrected as shown below:

Column 6, line 51, "section" (second occurrence) should be --sections--.

Column 6, line 58, change "plan" to --plane--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*